US006738994B2

(12) United States Patent
Barnett et al.

(10) Patent No.: US 6,738,994 B2
(45) Date of Patent: May 25, 2004

(54) DRAIN COVER

(75) Inventors: Ralph Lipsey Barnett, Wilmette, IL (US); Peter Joseph Poczynok, Oak Lawn, IL (US)

(73) Assignee: Triodyne Safety Systems, LLC, Niles, IL (US)

( * ) Notice: Subject to any disclaimer, the term of this patent is extended or adjusted under 35 U.S.C. 154(b) by 0 days.

(21) Appl. No.: 10/144,212

(22) Filed: May 10, 2002

(65) Prior Publication Data

US 2003/0208839 A1 Nov. 13, 2003

(51) Int. Cl.[7] ..... E04H 4/00

(52) U.S. Cl. ..... 4/507; 4/488; 4/504; 4/509; 4/496

(58) Field of Search ..... 4/488, 504, 507, 4/509, 496, 541.1; 138/110; 210/416.1, 416.2, 459, 460; 417/181; 137/561 R

(56) References Cited

U.S. PATENT DOCUMENTS 4,490,067 A 12/1984 Dahowski
4,742,593 A * 5/1988 Kallenbach ..... 15/1.7
4,912,782 A * 4/1990 Robbins ..... 4/678
4,973,403 A * 11/1990 Kozey ..... 210/170
5,454,940 A * 10/1995 Lakotish ..... 210/169
5,536,397 A * 7/1996 D'Offay ..... 210/169
5,665,248 A * 9/1997 McKiddy, II ..... 210/805
5,771,941 A * 6/1998 Almeida ..... 138/149
5,978,981 A * 11/1999 Nelson ..... 4/541.1
6,009,573 A * 1/2000 Thibault ..... 4/507
6,170,095 B1 1/2001 Zars

FOREIGN PATENT DOCUMENTS

DE 3106822 A1 * 10/1982 ..... F16L/41/00
EP 0 677 622 10/1995 ..... E03F/5/04
GB 2 297 110 7/1996 ..... E01C/11/22

* cited by examiner

*Primary Examiner*—Henry Bennett
*Assistant Examiner*—Azadeh Kokabi
(74) *Attorney, Agent, or Firm*—Pauley Petersen & Erickson

(57) ABSTRACT

A drain cover for a swimming pool, spa or tub drain that includes a hollow tube or shell having a slot formed in a wall therein and a fitting connecting the drain cover with respect to the drain.

14 Claims, 6 Drawing Sheets

DRAIN COVER

BACKGROUND OF THE INVENTION

1. Field of the Invention

This invention relates to drain cover having a slot that precludes entangling or trapping a swimmer or bather.

2. Description of Prior Art

Swimming pools and hot tubs typically include circulation systems that draw water from the pool or tub at high flow rates. When swimmers and bathers frolic underwater, they risk exposing their hair, fingers, clothing, etc. to active pool drains. For example, swimming a circuit to and from a drain is a common aquatic exercise that brings the swimmer into the vicinity of the drain, particularly the head of the swimmer. Strands of hair, for example, may be entrained into the drainage flow and pass through apertures in conventional drain gratings.

When hair strands are drawn through drain gratings, hair entanglement may proceed by knotting or wrapping mechanisms. Hair may be drawn into the drain and then entangled behind the grating element resulting in knotting. Alternatively, hair may be drawn into the drain and then wrapped around the grating element resulting in wrapping. Each of these mechanisms is sufficiently aggressive that a bather may be trapped even in the face of heroic intervention.

In addition, a swimmer may become trapped against a drain if the swimmer's body comes in sufficient contact with the drain so as to form a vacuum.

SUMMARY OF THE INVENTION

Accordingly, it is one object of this invention to provide a drain cover having a structure where no elements exist that may be trapped or wrapped by strands of hair.

It is another object of this invention to provide a drain cover having a structure that prevents the drain from creating a vacuum against the body of a swimmer.

These and other objects of this invention are addressed by a drain cover comprising one or more hollow tubes having a continuous single slot formed therein. Alternatively, the drain cover may comprise a shell having a simply connected slot formed therein. The drain cover according to this invention may be formed in a number of geometries, discussed in detail below.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

FIGS. 2–15 show various embodiments of drain cover 10 according to this invention. Drain cover 10 is preferably used in connection with a drain for a swimming pool, whirlpool bath, hot tub and/or other environment requiring drainage of water from an environment containing swimmers and/or bathers. As such, the term "drain" is used throughout the specification and claims to include any drain used in such an environment. Similarly, the terms swimmers and bathers are used interchangeably within this specification and include any person, animal and/or object that may become tangled or trapped in or against a drain cover.

Figure 1A:
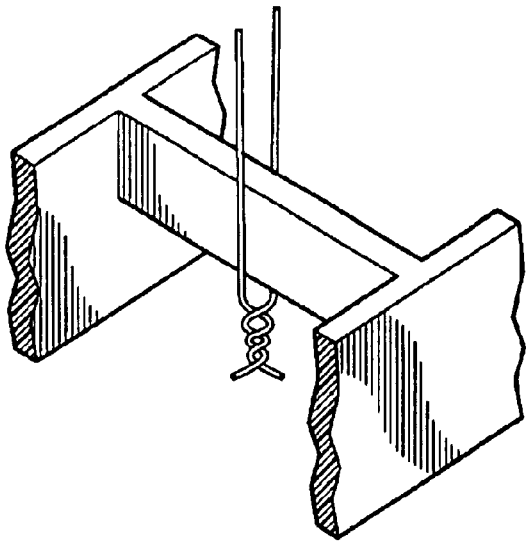
FIG. 1A PRIOR ART
FIG. 1A shows a hair entanglement condition in a knotting mode in a prior art drain cover grate.
Figure 1B:
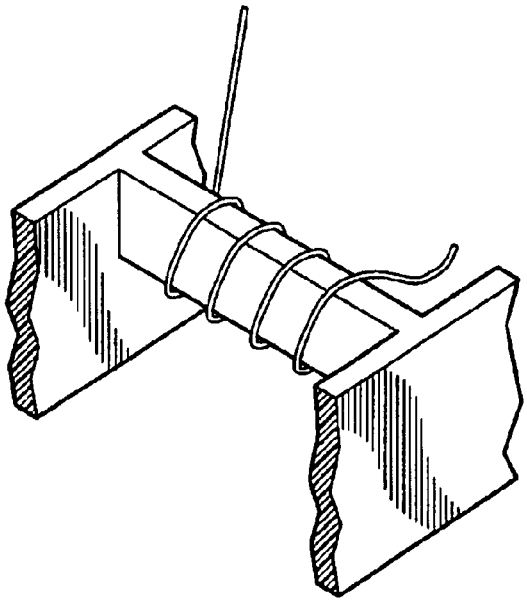
FIG. 1B PRIOR ART
FIG. 1B shows a hair entanglement condition in a wrapping mode in a prior art drain cover grate.

FIGS. 1A and 1B show a prior art grating element and two mechanisms by which a swimmer may get his hair tangled in such grating element. FIG. 1A shows how two or more groups of hair may become entangled and/or knotted under a bottom edge of the grating element, thus trapping the swimmer against the drain cover. FIG. 1B shows how one or more groups of hair may become wrapped around the grating element thus similarly trapping the swimmer against the drain cover.

Figure 2:
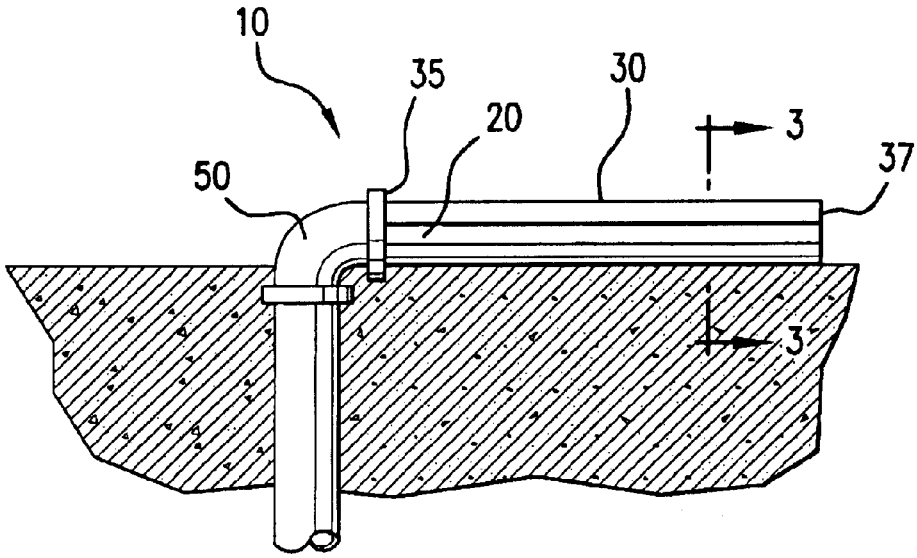
FIG. 2 is a side view of a drain cover according to one preferred embodiment of this invention.
Figure 3:
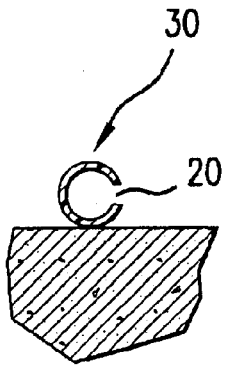
FIG. 3 is an open end view of the drain cover shown in FIG. 2.

FIGS. 2 and 3 show drain cover 10 according to a preferred embodiment of this invention wherein hollow tube 30 includes a single continuous slot 20 formed in a sidewall of hollow tube 30. Slot 20 may be located anywhere around the periphery of tube 30 and need not be parallel to the tube sides. Hollow tube 30 is preferably formed of plastic, such as polyvinyl chloride (PVC), and/or any other appropriate material that is durable, resistant to degradation, strong and fairly workable. Preferably, hollow tube 30 is constructed of a material that is readily available and easily manufactured, such as extruded, to keep costs of drain cover 10 to a minimum. Additionally, a manufacturing process like extrusion is associated with inexpensive dies as contrasted with expensive injection molding molds.

Hollow tube 30 preferably comprises a circular cross-section, but alternatively may comprise a non-circular cross-section, including elliptical, polygonal or any other appropriate cross-section known to those having ordinary skill in the art. Hollow tube 30 is preferably formed with a cross-section length and slot size suitable to use within a pool and to permit sufficient flow rate through drain cover 10 and into the drain.

Fitting 50 is then used to connect hollow tube 30 with respect to the drain. Fitting 50 may be an elbow joint, expansion joint or any other fitting that facilitates a secure fit between the drain and drain cover 10.

Figure 4:
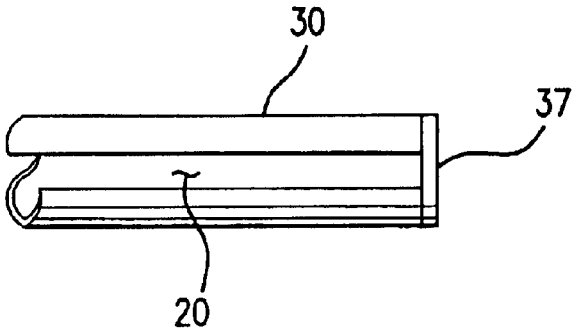
FIG. 4 is a side view of a drain cover having a solid end according to one preferred embodiment of this invention.

According to preferred embodiments of this invention, drain cover 10 may have end 37 of hollow tube 30 either open or closed. FIG. 3 shows hollow tube 30 having an open end 37 while FIG. 4 shows hollow tube having a closed or sealed end 37.

Figure 8:
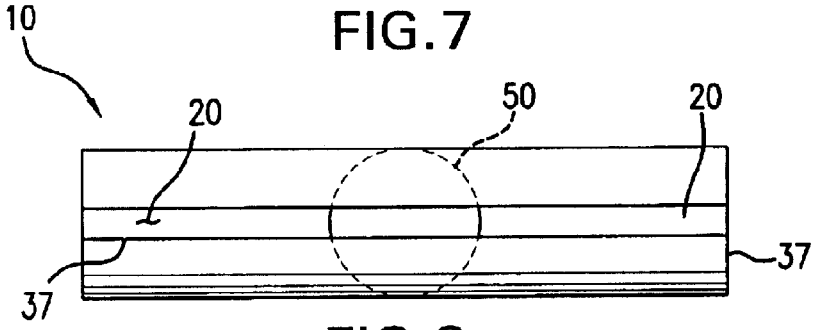
FIG. 8 is a top view of a drain cover according to one preferred embodiment of this invention.

Fitting 50 may be positioned at one end of hollow tube 30, such as at end 35 as shown in FIG. 2 or alternatively may be positioned between the ends of hollow tube 30 such as shown in FIG. 8. Preferably, fitting 50 results in drain cover 10 wherein hollow tube 30 and slot 20 extend parallel to the bottom of the pool/spa/tub, or hugs this bottom, and/or are recessed in this bottom.

Drain cover 10, generally, and hollow tube 30, specifically, are preferably of an appropriate length so that a swimmer cannot block the intake with his body to create a vacuum, thus preventing the potential for evisceration and body entrapment. According to one preferred embodiment of this invention, drain cover 10 is 24 inches long, although other lengths are also appropriate.

Likewise, the configuration of slot 20, specifically the width of slot 20, is selected to prevent swimmers' finger entrapment. According to one preferred embodiment of this invention, slot width will not exceed 8 mm or will be greater than 1 inch.

Figure 5A:
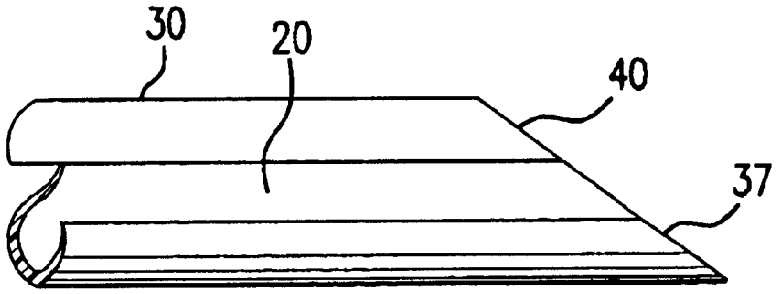
FIG. 5A is a side view of an end contouring of a drain cover according to one preferred embodiment of this invention.
Figure 5B:
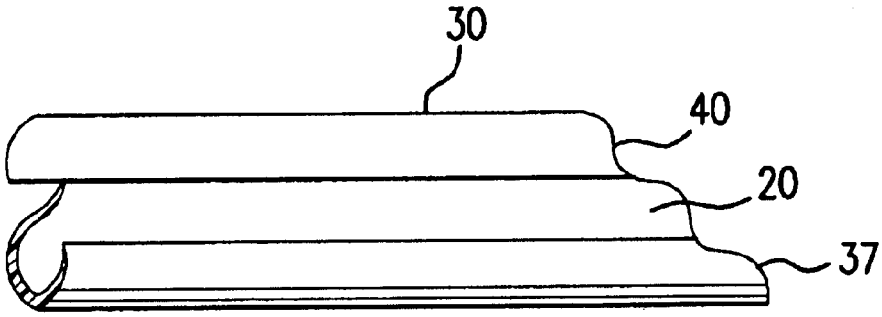
FIG. 5B is a side view of an end contouring of a drain cover according to one preferred embodiment of this invention.
Figure 5C:
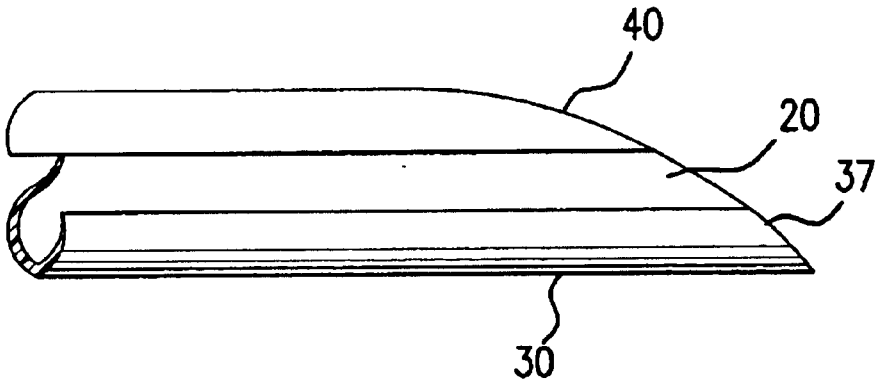
FIG. 5C is a side view of an end contouring of a drain cover according to one preferred embodiment of this invention.
Figure 6:
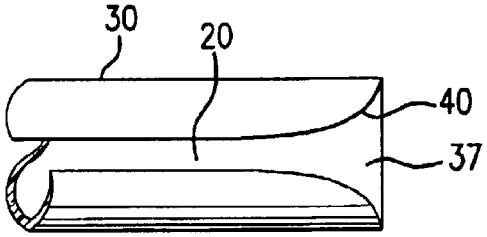
FIG. 6 is a top view of an end contouring of a drain cover according to one preferred embodiment of this invention.
Figure 7:
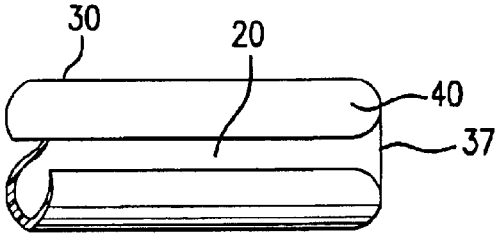
FIG. 7 is a top view of an end contouring of a drain cover according to one preferred embodiment of this invention.

Should free end 37 of drain cover 10 be configured so that it cannot be sealed by the human body, the length of drain cover 10 may be adjusted solely based upon flow capacity requirements, since evisceration or body entrapment will be prevented by the configured end. Such a configuration of open end 37 may involve sculpting open end 37 with alternative end contours 40 such as shown in FIGS. 5A–C, 6 and 7, designed to prevent the sealing of the open end 37 by the human body. FIGS. 5A–C show end 37 having alternative vertical contours to prevent sealing by the human body while FIGS. 6 and 7 show end 37 having alternative horizontal contours.

FIG. 8 shows one preferred embodiment of this invention wherein drain cover 10 includes fitting 50 positioned along hollow tube 30 to form a T-configuration. The T-configuration may include unequal tube lengths on either side of fitting 50 or equal tube lengths on either side of fitting 50.

Figure 9:
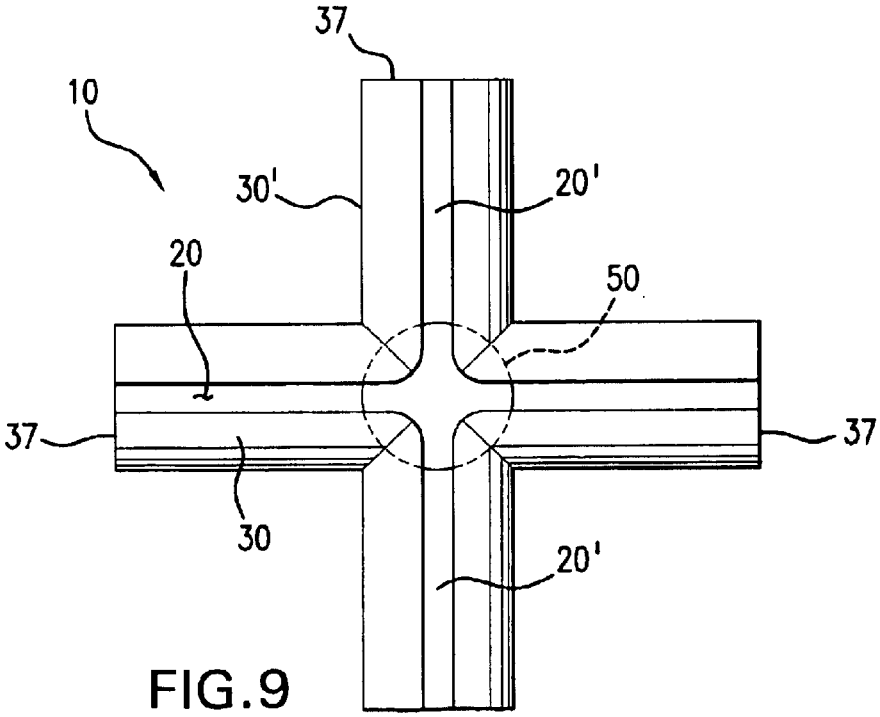
FIG. 9 is a top view of a drain cover according to one preferred embodiment of this invention.

According to one preferred embodiment of this invention, shown in FIG. 9, second hollow tube 30' is positioned perpendicularly with hollow tube 30, second hollow tube 30' having a second single continuous slot 20' intersecting slot 20. Such an arrangement may be preferable when a higher flow rate is desired or if the pool geometry requires a smaller footprint of drain cover 10.

Figure 10:
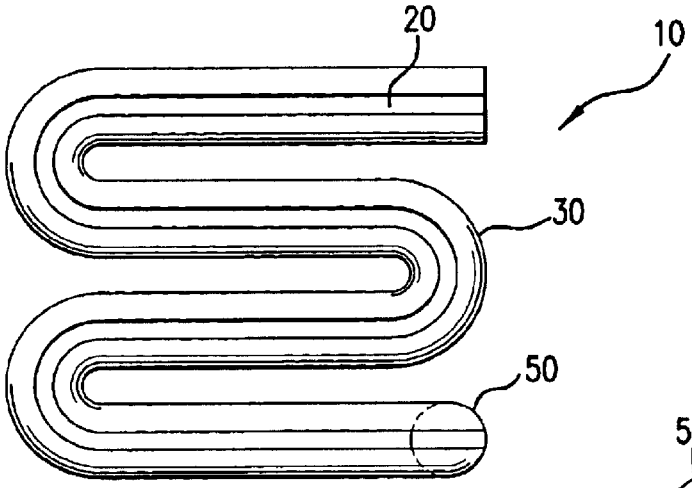
FIG. 10 is a top view of a drain cover according to one preferred embodiment of this invention.
Figure 11:
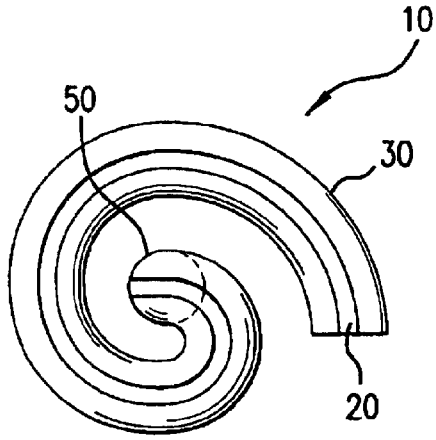
FIG. 11 is a top view of a drain cover according to one preferred embodiment of this invention.

According to one preferred embodiment of this invention, drain cover 10 may comprise hollow tube 30 formed in a serpentine configuration, such as shown in FIG. 10, with slot 20 formed in a corresponding serpentine configuration. Alternatively, hollow tube 30 may be coiled, such as shown in FIG. 11, with slot 20 following the curvature of hollow tube 30. Hollow tube 30 may alternatively be formed in any other configuration suitable for the application including decorative shapes, shapes that conform with a pool geometry or any other configuration within manufacturing limitations.

According to another preferred embodiment of drain cover 10 shown in FIGS. 12–15, shell 60 is positioned over the drain. Shell 60 preferably forms a spherical section having slot 20 within shell 60. Alternatively, shell 60 may be trapezoidal, square, rectangular, triangular, elliptical or any other suitable domed geometry.

Slot 20 may be curvilinear and may be located anywhere on shell 60, provided that the location does not result in a geometry that may entangle hair. Such a slot 20, which is mathematically defined as "simply connected" within shell 60, will result in a geometry wherein hair, string or other element may be extended within the slot and not wrap or entangle within shell 60.

Shell 60 may be arranged with ridges, ribs and/or other projections that cannot be encircled by hair and yet prevent sealing of drain cover 10 with a swimmer's body or extremity.

Figure 12:
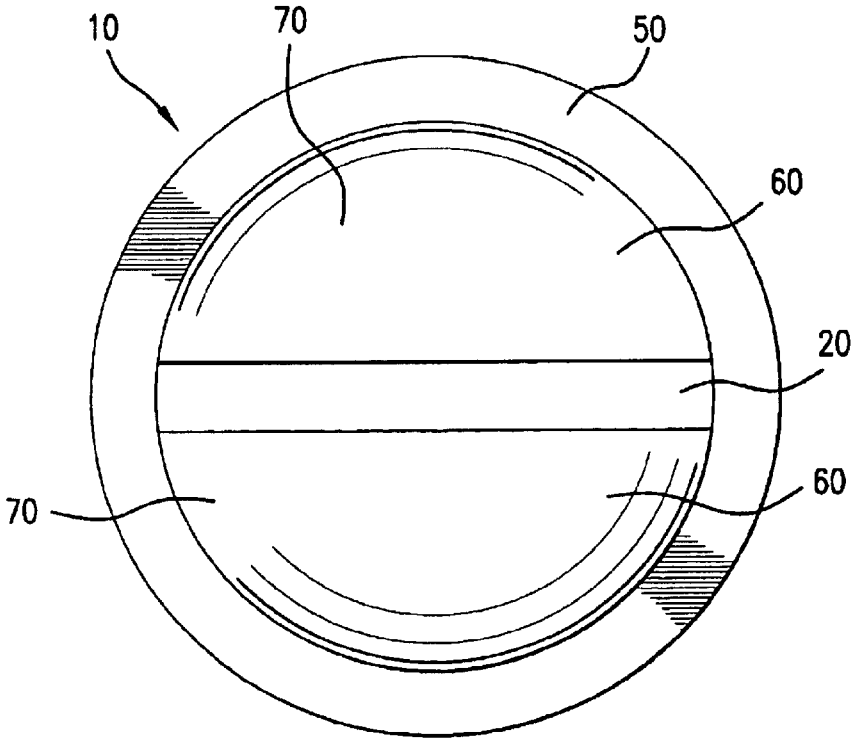
FIG. 12 is a top view of a drain cover according to one preferred embodiment of this invention employing shell elements.

FIG. 12 shows a top view of shell 60 according to one preferred embodiment of this invention. As shown, shell 60 includes two opposing parts 70 divided by slot 20.

Figure 13:
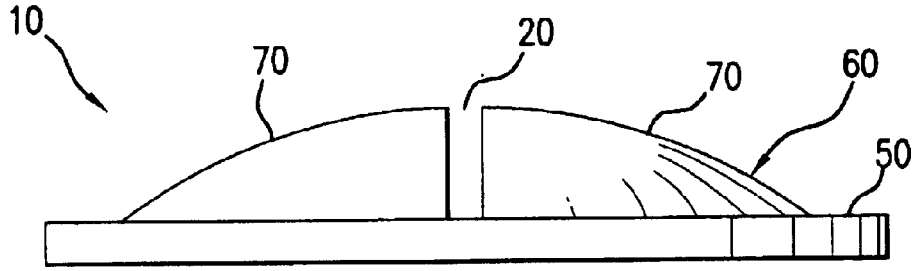
FIG. 13 is a side view of a drain cover according to one preferred embodiment of this invention employing shell elements.
Figure 14:
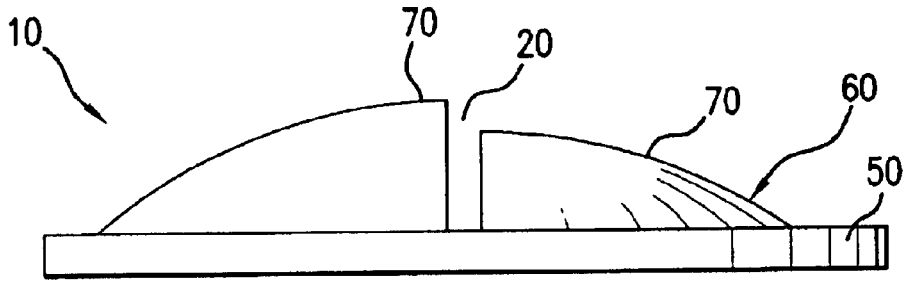
FIG. 14 is a side view of a drain cover according to one preferred embodiment of this invention employing shell elements.
Figure 15:
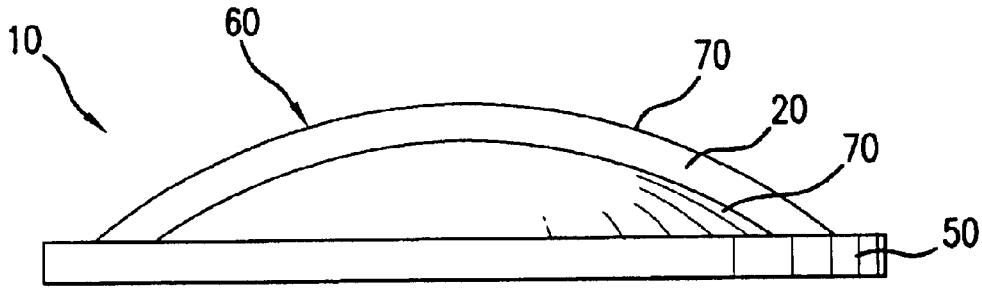
FIG. 15 is a front view of the drain cover shown in FIG. 14.

As shown in FIGS. 13 and 14, which are side views of two preferred shell embodiments, slot 20 is formed within the profile of shell 60 thereby dividing shell 60 into two opposing parts 70. As shown in FIGS. 14 and 15, the two opposing parts 70 of shell 60 may be positioned at different elevations.

Preferably, drain cover 10 according to this preferred embodiment of the invention is significantly larger than the drain. A larger shell 60 drain cover 10 will prevent body suction entrapment and/or evisceration. Shell 60 is preferably sufficiently large so as to preclude the covering of slot 20 by the body of a swimmer/bather precluding thereby the creation of a vacuum.

According to one preferred embodiment of this invention, the width of slot 20 within the shell embodiment 60 will not exceed 8 mm or will be greater than 1 inch.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A drain cover for a pool drain comprising:

a hollow tube having a single continuous slot formed in a wall of the hollow tube wherein the hollow tube includes two ends and the slot extends from end to end;

an open end formed in the hollow tube;

a contour formed along the open end, the contour extending from the slot in the hollow tube to an outer edge of the open end of the hollow tube; and a fitting to connect the hollow tube with respect to the drain, the single continuous slot extending entirely between the fitting and the open end, wherein the hollow tube extends parallel to and above a bottom of the pool.

2. The drain cover of claim 1 wherein the hollow tube has a circular cross-section.

3. The drain cover of claim 1 wherein the hollow tube has a non-circular cross-section.

4. The drain cover of claim 1 wherein the fitting is positioned at one end of the hollow tube.

5. The drain cover of claim 1 wherein the hollow tube is approximately 24 inches long.

6. The drain cover of claim 1 wherein the hollow tube is coiled.

7. The drain cover of claim 1 wherein a second hollow tube is positioned to intersect with the hollow tube, the second hollow tube having a second single continuous slot intersecting the slot of the hollow tube.

8. The drain cover of claim 1 wherein the hollow tube is formed in a serpentine configuration.

9. The drain cover of claim 1 wherein:

the hollow tube includes two ends and the slot formed in the wall of the hollow tube extends from end to end.

10. The drain cover of claim 1 wherein the fitting is positioned along the hollow tube to form a T-configuration.

11. The drain cover of claim 10 wherein the T-configuration includes unequal tube lengths on either side of the fitting.

12. The drain cover of claim 10 wherein the T-configuration includes equal tube lengths on either side of the fitting.

13. A drain cover for a pool drain comprising:

a hollow tube having a single continuous slot formed in a wall of the hollow tube wherein the hollow tube includes two ends and the slot extends from end to end;

an open end formed in the hollow tube;

a contour formed along the open end, the contour extending from the slot in the hollow tube to an outer edge of the open end of the hollow tube; and a fitting to connect the hollow tube with respect to the drain, the single continuous slot extending entirely between the fitting and the open end, wherein one end of the two ends is connected to the pool drain so that the hollow tube extends above the pool drain.

14. A drain cover for a pool drain comprising:

a hollow tube having a single continuous slot formed in a wall of the hollow tube wherein the hollow tube includes two ends and the slot extends from end to end;

an open end formed in the hollow tube;

a contour formed along the open end, the contour extending from the slot in the hollow tube to an outer edge of the open end of the hollow tube; and a fitting to connect the hollow tube with respect to the drain, the single continuous slot extending entirely between the fitting and the open end, wherein the hollow tube is positioned above the pool drain to straddle the pool drain.

* * * * *